US008468646B2

(12) United States Patent
Yoo

(10) Patent No.: US 8,468,646 B2
(45) Date of Patent: Jun. 25, 2013

(54) VACUUM CLEANER FOR USING IN BOTH UPRIGHT FORM AND CANISTER FORM

(75) Inventor: Dong-Hun Yoo, Gwangju (KR)

(73) Assignee: Samsung Electronics Co., Ltd., Gwangju-si (KR)

( * ) Notice: Subject to any disclaimer, the term of this patent is extended or adjusted under 35 U.S.C. 154(b) by 960 days.

(21) Appl. No.: 12/584,326

(22) Filed: Sep. 3, 2009

(65) Prior Publication Data

US 2010/0139030 A1 Jun. 10, 2010

(51) Int. Cl.
*A47L 5/26* (2006.01)

(52) U.S. Cl.
USPC ..... 15/331; 15/334; 15/335

(58) Field of Classification Search
USPC ..... 15/331, 334, 335
IPC ..... A47L 5/26
See application file for complete search history.

(56) References Cited

U.S. PATENT DOCUMENTS 6,058,559 A 5/2000 Yoshimi et al.

FOREIGN PATENT DOCUMENTS

| | | |
|---|---|---|
| GB | 2455382 | 6/2009 |
| GB | 2461613 | 1/2010 |
| JP | 08033591 | 2/1999 |
| JP | 11089757 | 4/1999 |
| JP | 2006525845 | 11/2006 |
| KR | 19950014136 | 11/1995 |

OTHER PUBLICATIONS

Combined Search and Examination Report dated Feb. 4, 2010 corresponding to UK Patent Application No. 0917561.3.

*Primary Examiner* — David Redding
(74) *Attorney, Agent, or Firm* — Ohlandt, Greeley, Ruggiero & Perle, LLP

(57) ABSTRACT

A vacuum cleaner for using both in an upright form and a canister form, which can stably support and store a cleaner body and at the same time, reduce a suction nozzle assembly in size, is disclosed. The vacuum cleaner includes a pivot unit formed to pivot a connection pipe disposed between an extended tube and a nozzle body of a suction nozzle assembly, on at least two points.

22 Claims, 11 Drawing Sheets

VACUUM CLEANER FOR USING IN BOTH UPRIGHT FORM AND CANISTER FORM

CROSS-REFERENCE TO RELATED APPLICATIONS

This application claims the benefit under 35 U.S.C. §119 (a) of Korean Patent Application No. 10-2008-0124891, filed on Dec. 9, 2008, in the Korean Intellectual Property Office, the entire content of which is hereby incorporated by reference.

BACKGROUND OF THE INVENTION

1. Field of the Invention

The present disclosure relates to a vacuum cleaner. More particularly, the present disclosure relates to a vacuum cleaner for using in both an upright form and a canister form, which can use in an upright form or a canister form according to a shape or condition of a surface to be cleaned in cleaning.

2. Description of the Related Art

In general, an upright vacuum cleaner forcibly draws in dust or dirt along with air from the outside by a suction force generated within a cleaner body, so that it cleans a surface to be cleaned. Such an upright vacuum cleaner is provided with a suction nozzle assembly formed to be movable along the surface to be cleaned, and a cleaner body mounted on the suction nozzle assembly. In addition, in the cleaner body are formed a dust separating unit to collect the dust or dirt drawn in from the surface to be cleaned, and a motor chamber in which a suction motor is installed on a lower side of the dust separating unit. The upright vacuum cleaner as described above is usually used in cleaning a surface to be cleaned having a relatively wide cleaning area, such as a floor or a carpet, because the cleaner body is mounted on the suction nozzle assembly to move therewith.

However, if such an upright vacuum cleaner is used to clean a surface having a relatively narrow cleaning area, such as a stairway or the like, the cleaning work does not only becomes difficult, but also a cleaning efficiency is deteriorated, because a user has to frequently hold up and move both the heavy cleaner body and the suction nozzle assembly.

To address the problems as described above, there has recently been developed and used a vacuum cleaner for using in both an upright form and a canister form in which a cleaner body is detachably installed on a suction nozzle assembly to be able to select an upright form or a canister form according to a shape or condition of a surface to be cleaned in cleaning. The upright form is a form where the vacuum cleaner is used with the cleaner body mounted on the suction nozzle assembly and the canister form is a form where the vacuum cleaner is used with the cleaner body separated from the suction nozzle assembly and placed on the surface to be cleaned.

Such a vacuum cleaner for using in both the upright form and the canister form is generally stored in an upright position with the suction nozzle assembly on a floor. Accordingly, to stably support the cleaner body including the dust separating unit and the motor chamber, the suction nozzle assembly is formed to have a relatively large and wide size, particularly, a back and forth width. As a result, the conventional vacuum cleaner for using in both the upright form and the canister form does not present any problem when it is used in the upright form to clean the surface to be cleaned having the relatively wide cleaning area, such as the floor or the carpet. However, when the conventional vacuum cleaner is used in the canister form to clean the surface having the narrow back and forth width, such as the stairway or the like, it may present a problem in that a portion of the suction nozzle assembly is projected beyond the narrow back and forth width of the stairway to cause a bottom surface of the nozzle body not to come in complete contact with the stairway and thus to deteriorate a dust suction efficiency. In addition, because a single pivot connection part between a nozzle body of the suction nozzle assembly and a connection pipe, to which user's force and a weight of an extended tube coupled with the suction nozzle assembly are applied, is positioned out of the stairway along with the portion of the suction nozzle assembly projected beyond the back and forth width of the stairway, the user has to move the suction nozzle assembly while not freely pushing it to the stairway and thus the cleaning work comes difficult.

SUMMARY OF THE INVENTION

An aspect of the present disclosure is to address at least the above problems and/or disadvantages and to provide at least the advantages described below. Accordingly, an aspect of the present disclosure is to provide a vacuum cleaner for using both in an upright form and a canister form, which can stably support and store a cleaner body and at the same time, reduce a suction nozzle assembly in size.

In accordance with an aspect of the present disclosure, a vacuum cleaner for using both in a upright form and a canister form includes a pivot unit formed to pivot a connection pipe disposed between an extended tube and a nozzle body of a suction nozzle assembly, on at least two points.

Here, the connection pipe may be divided into at least first and second parts, and the pivot unit may pivotably connect between the nozzle body and the first part of the connection pipe and between the first and the second parts of the connection pipe.

The pivot unit may include a first pivot to connect the first part of the connection pipe to the nozzle body to be able to pivot within a first angle range thereto, and a second pivot to connect the second part to the first part of the connection pipe to be able to pivot within a second angle range thereto. At this time, each of the first and the second angle ranges may be between 0 and 90 degrees.

When the vacuum cleaner is used in the upright form, the first part of the connection pipe may be positioned approximately parallel to a surface to be cleaned and the second part of the connection pipe may be operated to pivot within the second angle range about the second pivot. Here, to mount a cleaner body connected to the extended tube through a suction hose, on the first part of the connection pipe and the second pivot, the vacuum cleaner may further include a mounting part. The mounting part may include a mounting protrusion formed on the second part of the connection pipe, a mounting groove formed on the cleaner body to correspond to the mounting protrusion, and accommodating the mounting protrusion, and a supporting recess formed on a rear surface of the cleaner body in a shape corresponding to an upper part of the second pivot to allow the upper part of the second pivot to be supported therein. At this time, to more stably support the cleaner body, the mounting part may further include an elongated groove formed on a portion of the cleaner body facing the extended tube to accommodate and support a part of the extended tube.

Also, when the vacuum cleaner is used in the canister form, the second part of the connection pipe may be fixed approximately parallel to the first part of the connection pipe, and the second part of the connection pipe may be operated to pivot within the first angle range about the first pivot.

The first pivot may include a first cylinder coupled in fluid communication with one end of the first part to be perpendicular to the first part and having a suction opening, and a supporter formed on the nozzle body to connect the suction opening with an air passage of the nozzle body and to accommodate and rotatably support the first cylinder.

To prevent the first part from pivoting out of the first angle range to the nozzle body, the supporter may include a first pivot-restricting part. The first pivot-restricting part may include a first semicircular recess formed on the nozzle body to come in contact with the one end of the first part when the first part is in a lower limit of the first angle range, and a second semicircular recess formed on the nozzle body to come in contact with the one end of the first part when the first part is in an upper limit of the first angle range.

The second pivot may include a second cylinder coupled in fluid communication with the other end of the first part to be perpendicular to the first part and having an exhaust opening, and a cylindrical supporter coupled in fluid communication with one end of the second part to be perpendicular to the second part thus to fluidly communicate the exhaust opening with the second part, and accommodating and rotatably supporting the second cylinder.

To prevent the second part from pivoting out of the second angle range to the first part, the cylindrical supporter may include a second pivot-restricting part. The second pivot-restricting part may include an opening formed on the cylindrical supporter in a circumferential direction thereof, and having a first semicircular groove to come in contact with the other end of the first part when the second part is in an upper limit of the second angle range and a second semicircular groove to come in contact with the other end of the first part when the second part is in a lower limit of the second angle range.

To lock at least one of the first part and the second part in a first angle and a second angle, the at least one of the first pivot and the second pivot, preferably, the second pivot may further include a locking part. Here, the first and second angles may be 0 and 90 degrees, respectively.

The locking part may be formed to release the second part from locking when pushed or touched. For this, the locking part may include a moving member elastically supported in a moving groove formed at one side of the second cylinder thus to be movable in a horizontal direction and having at least locking protrusion, a fixing member fixed on the cylindrical supporter to face the one side of the second cylinder and having at least one locking groove to accommodate the at least locking protrusion, and a lever elastically supported on the fixing member to be movable in a vertical direction and moving the moving member in the horizontal direction according to upward or downward moving operation to allow the at least locking protrusion to engage with or disengage from the at least one locking groove.

Also, the locking part may lock the pivoting of the second part when the second part is in a parallel position approximately parallel to the first part or a vertical position approximately perpendicular to the first part. For this, the at least locking protrusion of the moving member may include four protrusions circumferentially disposed in an angle of 90 degrees on the moving member, and the at least one locking groove of the fixing member may include four grooves circumferentially disposed in an angle of 90 degrees in the fixing member to face the four protrusions, respectively.

Alternatively, at least one of the first and the second pivots may include at least one flexible hose to connect at least one of between the nozzle body and the first part and between the first part and the second part. At this time, the at least one flexible hose may be protected by a protection cover disposed the at least one of between the nozzle body and the first part and between the first part and the second part to surround the at least one flexible hose.

BRIEF DESCRIPTION OF THE DRAWING FIGURES

The above and other objects, features, and advantages of certain exemplary embodiment of the present disclosure will be more apparent from the following description taken in conjunction with the accompanying drawings, in which.

Throughout the drawings, the same reference numerals will be understood to refer to the same elements, features, and structures.

DETAILED DESCRIPTION OF THE EXEMPLARY EMBODIMENTS

Hereinafter, a vacuum cleaner for using both in an upright form and a canister form according to an exemplary embodiment of the present disclosure will be described in detail with reference to the accompanying drawing figures.

Figure 1:
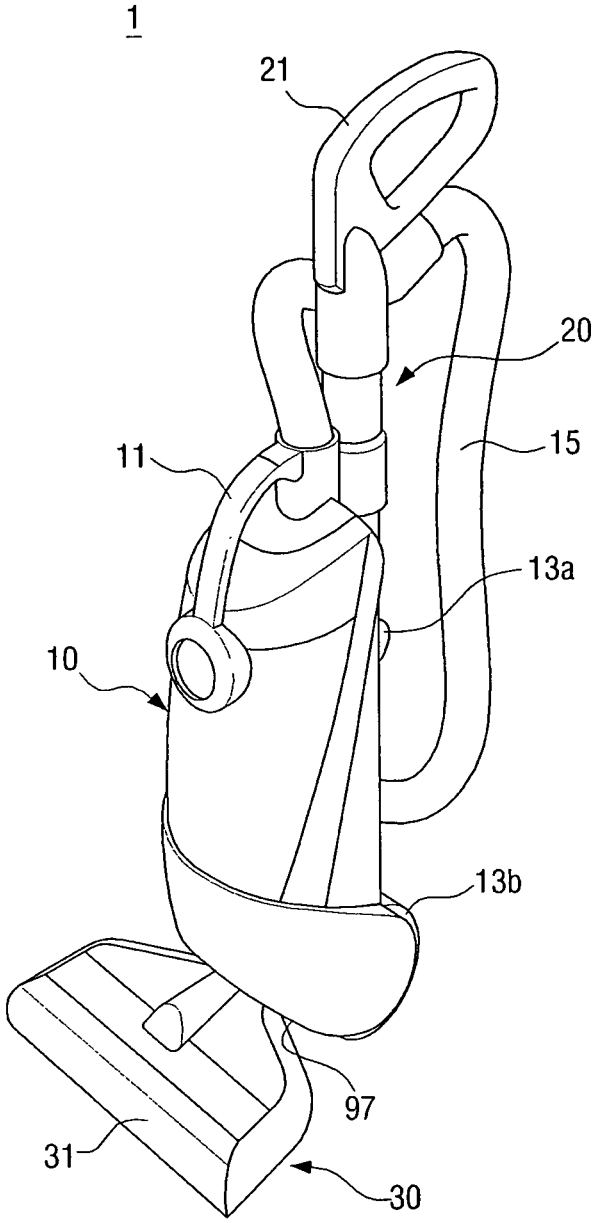
FIG. 1 is a perspective view exemplifying a vacuum cleaner for using both in an upright form and a canister form according to an exemplary embodiment of the present disclosure stored in a storing position of the upright form.
Figure 2:
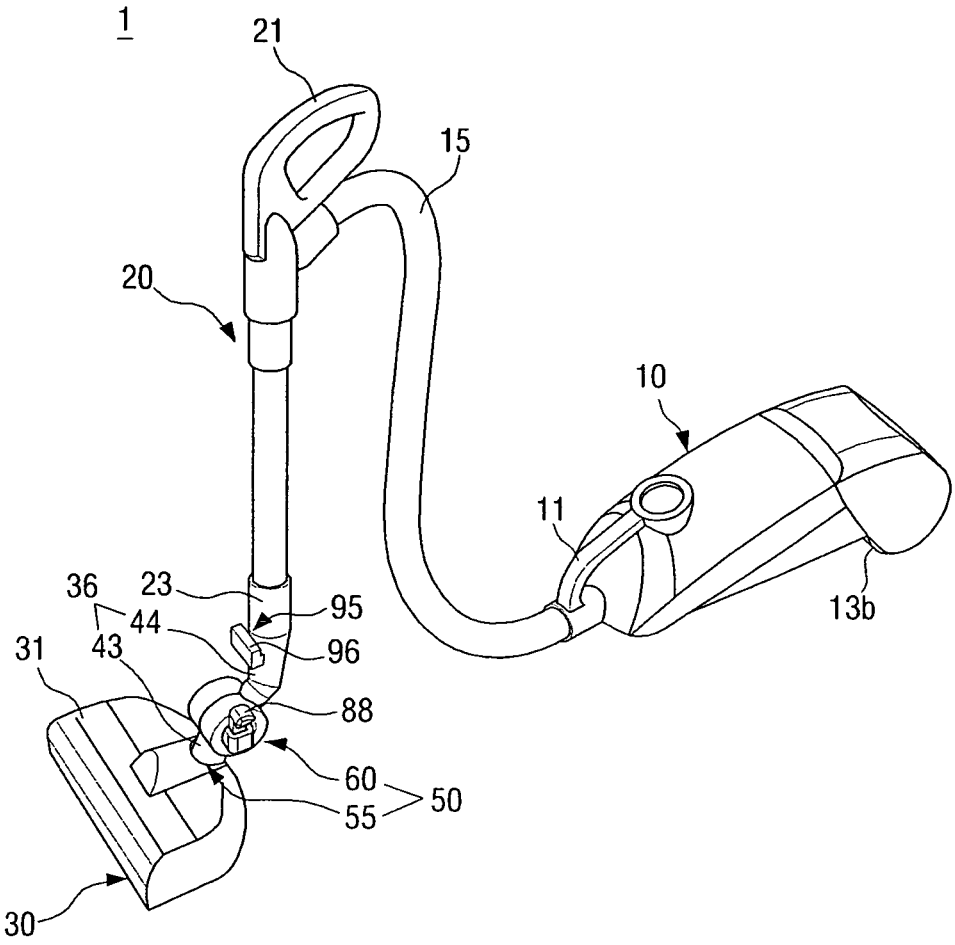
FIG. 2 is a schematic perspective view exemplifying the vacuum cleaner of FIG. 1 used in the canister form.

FIGS. 1 and 2 are schematic perspective views exemplifying an example of a vacuum cleaner 1 for using both in an upright form and a canister form according to an exemplary embodiment of the present disclosure, which are used in the upright form and the canister form, respectively.

Referring to FIGS. 1 and 2, the vacuum cleaner 1 for using both in the upright form and the canister form according to the exemplary embodiment of the present disclosure includes a cleaner body 10, an extended tube 20, and a suction nozzle assembly 30.

The inside of the cleaner body 10 is divided into a motor chamber (not shown) and a dust separating unit (not shown) for separating a dirt or dust. A suction motor (not shown) is mounted in the motor chamber. A cleaner body handle 11 is formed on a top of the cleaner body 10. Front and rear wheels 13*a* and 13*b* are disposed on a bottom surface of the cleaner body 10, so that the cleaner body 10 can be easily moved along a surface to be cleaned when the vacuum cleaner is used in the canister form.

An operation handle 21 is formed on a top of the extended tube 20. A suction hose 15, which is connected with the cleaner body 10, is coupled to a lower part of the operation handle 21. A female socket 23 in which wiring terminals (not shown) are disposed so as not to be exposed to the outside is formed in a lower part of the extended tube 20. The female socket 23 is coupled with a male socket 45 (see FIGS. 3 and 4) formed on a top of a second part 44 of a connection pipe 36 of the suction nozzle assembly 30 to be described later, when the extended tube 20 is coupled with the connection pipe 36. The wiring terminals of the female socket 23 are electrically connected to corresponding wiring terminals (not shown) of the male socket 45, so that they are electrically connected with a driving motor 37 (see FIG. 4) in a nozzle body 31 of the suction nozzle assembly 30.

Figure 3:
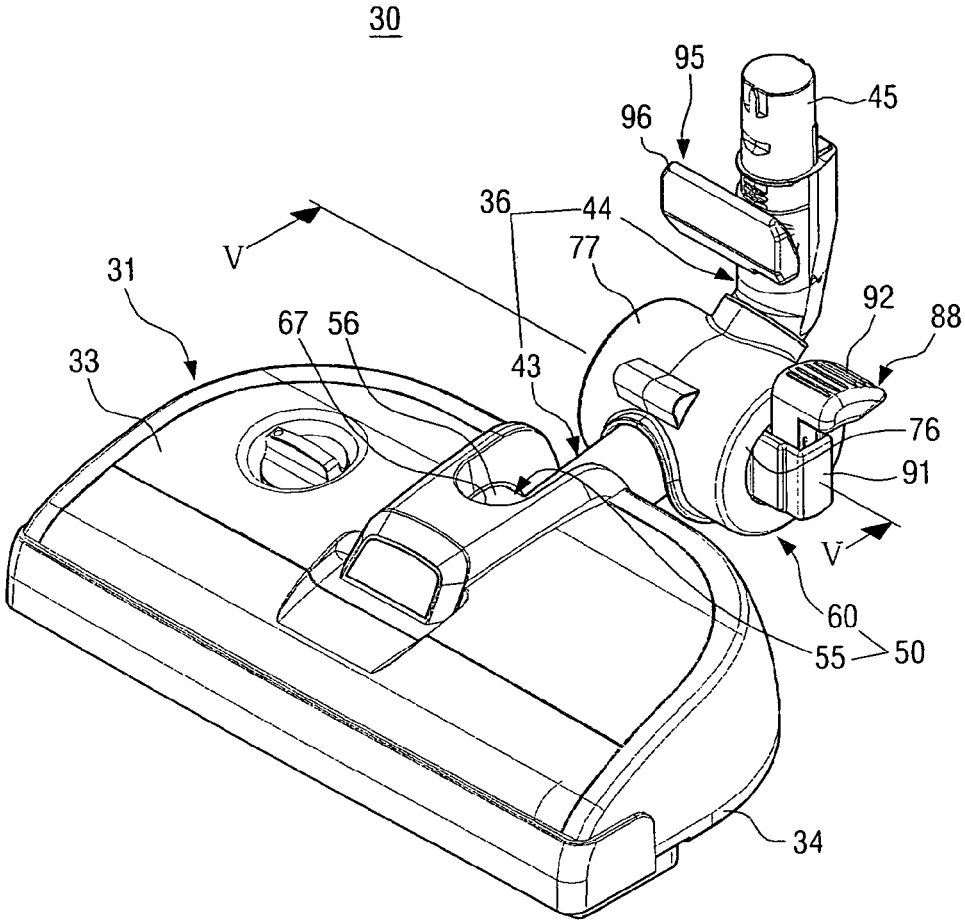
FIG. 3 is a perspective view exemplifying a suction nozzle assembly of the vacuum cleaner of FIG. 1.
Figure 4:
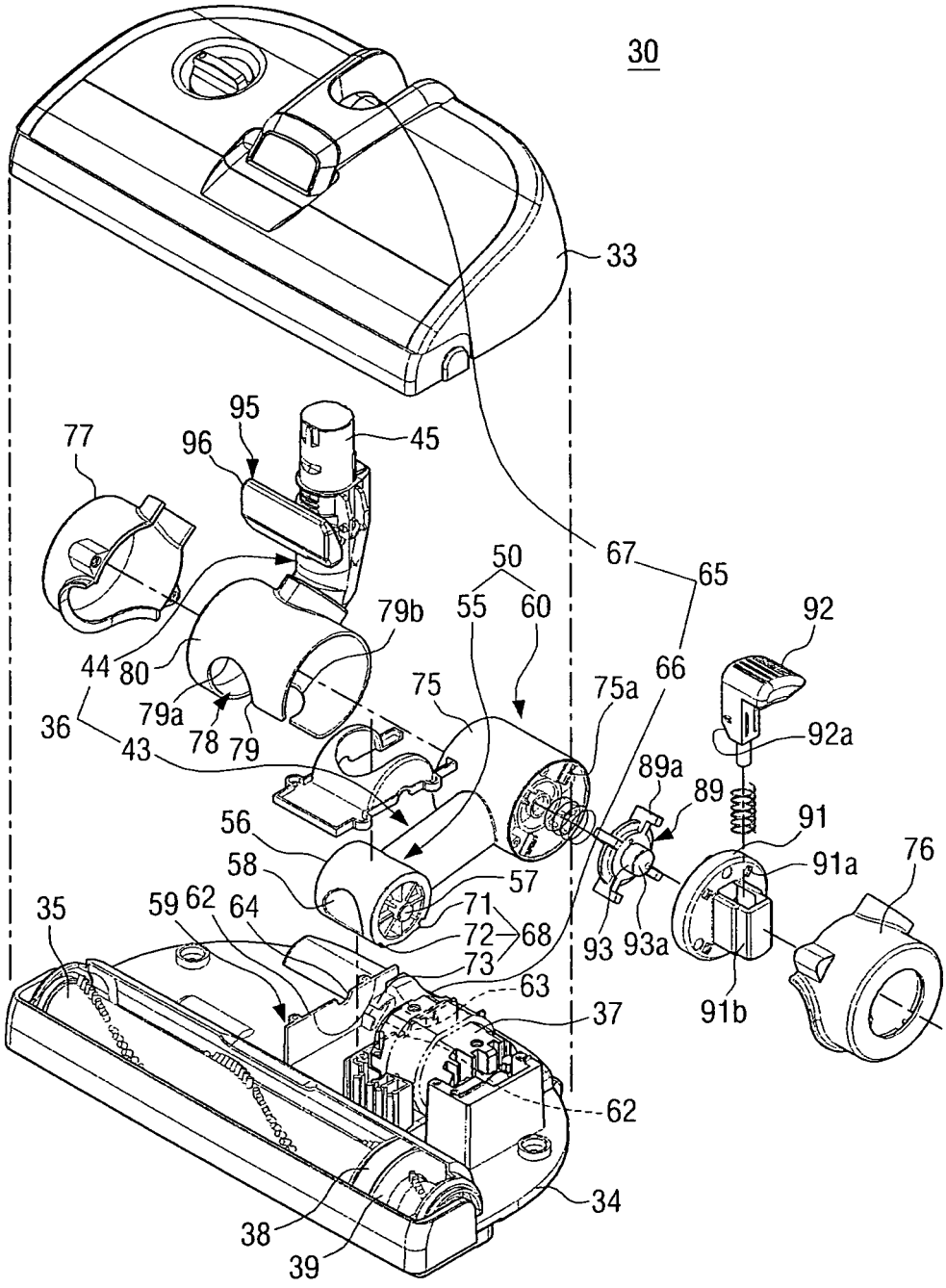
FIG. 4 is an exploded view of the suction nozzle assembly of FIG. 3.

As shown in FIGS. 3 and 4, the suction nozzle assembly 30 includes the nozzle body 31, the connection pipe 36, and a pivot unit 50.

The nozzle body 31 is made up of upper and lower casings 33 and 34. The upper and the lower casings 33 and 34 are coupled with each other by a screw and the like. An air passage (not shown) is formed in the upper and the lower casings 33 and 34, so that it is fluidly connected with an air inlet (not shown) formed in the lower casing 34 under a drum brush 35. To drive the drum brush 35, the driving motor 37 is disposed on a supporting bracket in the upper and the lower casings 33 and 34 of the nozzle body 31. The driving motor 37 is connected through a timing belt 38 to a driven teeth 39 formed on one side of the drum brush 35. As shown in FIGS. 6A through 8, a plurality of wheels 41 is disposed on a bottom surface of the lower casing 34, so that the suction nozzle assembly 20 can be easily moved during cleaning.

The connection pipe 36, which connects between the nozzle body 31 and the extended tube 20, is disposed on the nozzle body 31 between the nozzle body 31 and the extended tube 20. The connection pipe 36 is divided into first and second parts 43 and 44, so that it can be pivotably connected at least two points by the pivot unit 50 according to the present disclosure.

The pivot unit 50 allows the connection pipe 36 to be pivotable on the at least two points, for example, between the nozzle body 31 and the first part 43 of the connection pipe 36 and between the first and the second parts 43 and 44 of the connection pipe 36.

For this, the pivot unit 50 includes a first pivot 55, and a second pivot 60.

The first pivot 55 connects the first part 43 of the connection pipe 36 to the nozzle body 31 to be able to pivot within a first angle range of, for example, 0 to 90 degrees thereto. The first pivot 55 is made up of a first cylinder 56 and a supporter 59. The first cylinder 56 at one side thereof is coupled in fluid communication with one end of the first part 43 to be perpendicular to the first part 43 of the connection pipe 36 and at other side thereof has a suction opening 58. A rotation shaft 57 is formed on and projected from centers of both sides of the first cylinder 56. The supporter 59 is provided with first and second partitions 62 and 63 and third and fourth partitions (not shown). The first and the second partitions 62 and 63 are formed in a spaced-apart relation to each other in the middle of a rear part of the lower casing 34, and the third and the fourth partitions are formed in a spaced-apart relation to each other at positions corresponding to the first and the second partitions 62 and 63 in the middle of a rear part of the upper casing 33. Accordingly, when the upper and the lower casings 33 and 34 are coupled with each other, the first to fourth partitions 62 and 63 form a space to accommodate the first cylinder 56 and to communicate the suction opening 58 with the air passage of the nozzle body 31.

Also, semicircular grooves 64 are formed in the middles of tops of the first to fourth partitions 62 and 63, respectively. The semicircular grooves 64 form circular supporting holes for rotatably supporting the rotation shaft 57 of the first cylinder 56 when the upper and the lower casings 33 and 34 are coupled with each other.

To prevent the first part 43 of the connection pipe 36 from pivoting out of the first angle range of 0 to 90 degrees to the nozzle body 31, the supporter 59 is provided with a first pivot-restricting part 65. The first pivot-restricting part 65 is made up of first and second semicircular recesses 66 and 67. The first semicircular recess 66 is formed on the lower casing 34 of the nozzle body 31 between the first and the second partitions 62 and 63 of the supporter 59, and comes in contact with the one end of the first part 43 of the connection pipe 36 to restrict the rotation thereof when the one end of the first part 43 of the connection pipe 36 is in a lower limit, that is, approximately 0 degree (an approximately horizontal position), of the first angle range of 0 to 90 degrees (see FIGS. 3, 6B and 7B). The second semicircular recess 67 is formed on the upper casing 33 of the nozzle body 31 between the third and the fourth partitions of the supporter 59, and comes in contact with the one end of the first part 43 of the connection pipe 36 to restrict the rotation thereof when the one end of the first part 43 of the connection pipe 36 is in an upper limit, that is, approximately 90 degrees (an approximately vertical position), of the first angle range of 0 to 90 degrees.

Alternatively, to lock the first part 43 of the connection pipe 36 in the approximately horizontal position and the approximately vertical position, the first pivot 55 may further include a first locking part 68. The first locking part 68 may be made up of first and second locking protrusions 71 and 72, and a first elastic locking groove 73. The first and the second locking protrusions 71 and 72 are formed in an angle interval of approximately 90 degrees to each other on and are slightly projected from a circumferential surface of one side of the first cylinder 56. The first elastic locking groove 73 is formed on the lower casing 34 between the first partition 62 of the supporter 59 and the first semicircular recess 66. When the first part 43 of the connection pipe 36 is in the approximately vertical position, the second locking protrusion 72 is inserted into the first elastic locking groove 73 to lock the first part 43 of the connection pipe 36 in the approximately vertical position. When the first part 43 of the connection pipe 36 is in the approximately horizontal position, the first locking protrusion 71 is inserted in to the first elastic locking groove 73 to lock the first part 43 of the connection pipe 36 in the approximately horizontal position. A locking force between the first locking protrusion 71 or the second locking protrusion 72 and the first elastic locking groove 73 is set, so that when the vacuum cleaner is used in the canister form, the locking between the first locking protrusion 71 or the second locking protrusion 72 and the first elastic locking groove 73 can be easily released by user's force of rotating the extended tube 2 about the first pivot 55. Since such a first locking part 68 is not frequently used, it may be omitted, if necessary.

The second pivot 60 connects the second part 44 of the connection pipe 36 to the first part 43 to be able to pivot within a second angle range of, for example, 0 to 90 degrees thereto. The second pivot 60 is made up of a second cylinder 75 and a cylindrical supporter 80. The second cylinder 75 at one side thereof is coupled in fluid communication with the other end of the first part 43 to be perpendicular to the first part 43 of the connection pipe 36 and at other side thereof has an exhaust opening 74 (see FIG. 5). The cylindrical supporter 80 accommodates and rotatably supports the second cylinder 75, and is coupled in fluid communication with one end of the second part 44 to be perpendicular to the second part 44 of the connection pipe 36 to fluidly communicate the exhaust opening 74 with the second part 44 of the connection pipe 36. The cylindrical supporter 80 is disposed in right and left casings 76 and 77, and closed up by the right and left casings 76 and 77.

To prevent the second part 44 of the connection pipe 36 from pivoting out of the second angle range of 0 to 90 degrees to the first part 43 of the connection pipe 36, the cylindrical supporter 80 is provided with a second pivot-restricting part 78. As illustrated in FIG. 4, the second pivot-restricting part 78 is made up of an opening 79 with first and second semicircular grooves 79*a* and 79*b*, which are circumferentially formed in the cylindrical supporter 80. The first semicircular groove 79*a* comes in contact with the other end of the first part 43 of the connection pipe 36 to restrict the pivoting or rotation of the second part 44 of the connection pipe 36 when the second part 44 of the connection pipe 36 is in an upper limit, that is, approximately 90 degrees (a vertical position approximately perpendicular to the first part 43), of the second angle range of 0 to 90 degrees (see FIGS. 3, and 6B). The second semicircular groove 79*b* comes in contact with the other end of the first part 43 of the connection pipe 36 to restrict the pivoting of the second part 44 of the connection pipe 36 when the second part 44 of the connection pipe 36 is in a lower limit, that is, approximately 0 degree (a parallel position approximately parallel to the first part 43), of the second angle range of 0 to 90 degrees (see FIG. 8).

To lock the second part 44 of the connection pipe 36 in approximately 0 degree (the parallel position approximately parallel to the first part 43) or approximately 90 degrees (the vertical position approximately perpendicular to the first part 43), the second pivot 60 may further include a second locking part 88.

Figure 5:
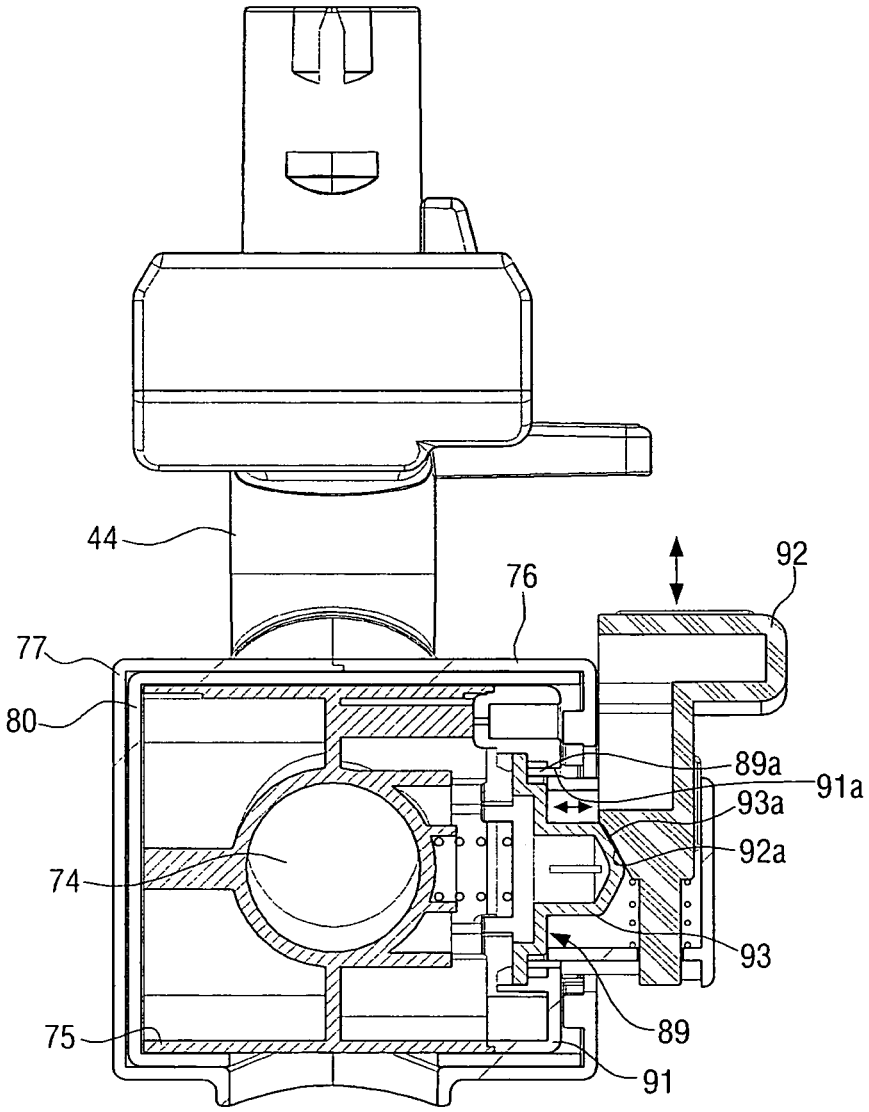
FIG. 5 is a cross-sectional view of the suction nozzle assembly taken along line V-V of FIG. 3.

The second locking part 88 may be configured to release the locking of the second part 44 of the connection pipe 36 when pushed or touched. For this, the second locking part 88 is made up of a moving member 89, a fixing member 91 and a lever 92. As illustrated in FIG. 5, the moving member 89 is elastically supported by a spring to be movable left and right in a moving groove 75*a* formed in one side of the second cylinder 75. A guide protrusion 93 with an inclined sliding surface 93*a* is formed on and projected from a center of one side of the moving member 89, and at least one second locking protrusion 89*a* is formed on and projected from the one side of the moving member 89 around the guide protrusion 93 of the moving member 89. The fixing member 91 is fixed on the cylindrical supporter 80 to face the one side of the second cylinder 75, and has at least one second locking groove 91*a* formed in a position corresponding to the second locking protrusion 89*a* to accommodate and lock the second locking protrusion 89*a*. The lever 92 is elastically supported in a guide slot 91*b* of the fixing member 91 by a spring to be movable in a vertical direction, and has a corresponding inclined sliding surface 92*a* formed on a lower part thereof to be engaged with the inclined sliding surface 93*a* of the guide protrusion 93.

Figure 6A:
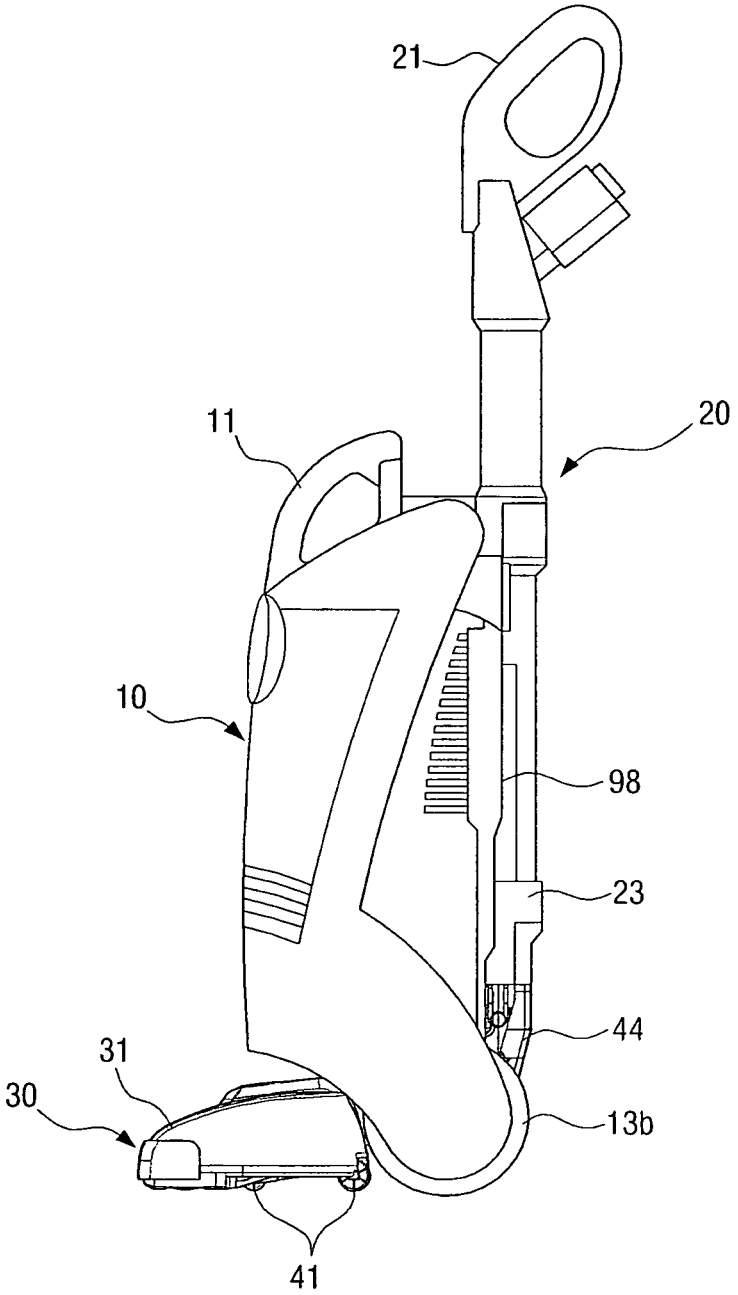
FIG. 6A is a side elevation of the vacuum cleaner of FIG. 1.
Figure 6B:
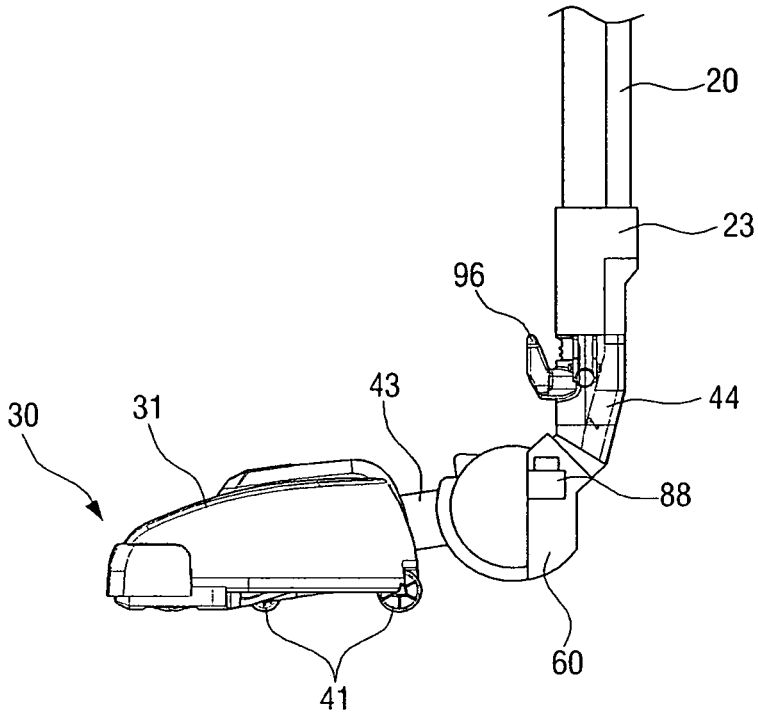
FIG. 6B is a partial side elevation exemplifying the vacuum cleaner of FIG. 6A from which a cleaner body is omitted.

In addition, the second locking part 88 may lock the pivoting of the second part 44 of the connection pipe 36 when the second part 44 of the connection pipe 36 is in a parallel position where it is unfolded parallel with the first part 43 of the connection pipe 36 (see FIG. 8) or a vertical position where it is bent in a right angle to the first part 43 of the connection pipe 36 (see FIGS. 3 and 6B). For this, in the exemplary embodiment, the at least one second locking protrusion 89*a* of the moving member 89 is made up of four protrusions circumferentially disposed in an angle of 90 degrees in conformity to the parallel position and the vertical position of the second part 44 of the connection pipe 36, and the at least one locking groove 91*a* of the fixing member 91 is made up of four grooves circumferentially disposed in an angle of 90 degrees in the fixing member 91 to face the four protrusions, respectively.

Accordingly, when the lever 92 is moved down by user's push or touch, the moving member 89 is moved right (left in FIGS. 4 ad 5) along the moving groove 75*a* as the inclined sliding surface 93*a* is pushed by the corresponding inclined sliding surface 92*a* of the lever 92, and thus the second locking protrusions 89*a* of the moving member 89 are moved away from the second locking grooves 91*a* of the fixing member 91. As a result, the second part 44 of the connection pipe 36 coupled with the second cylinder 75 can be freely pivoted to the first part 43 of the connection pipe 36.

To the contrary, as illustrated in FIG. 5, when the lever 92 is moved up by user's push or touch release, the moving member 89 is moved left (right in FIGS. 4 and 5) along the moving groove 75*a* by the spring, and thus the second locking protrusions 89*a* of the moving member 89 are inserted into the second locking grooves 91*a* of the fixing member 91. As a result, the pivoting of the second part 44 of the connection pipe 36 to the first part 43 of the connection pipe 36 can be locked. However, at this time, if the second part 44 of the connection pipe 36 is not in the parallel position and the vertical position, the second locking protrusions 89*a* are not aligned with the second locking grooves 91*a* since the second locking protrusions 89*a* and the second locking grooves 91*a* are circumferentially disposed in an angle of 90 degrees in conformity to the parallel position and the vertical position of the second part 44 of the connection pipe 36. Accordingly, the second locking protrusions 89*a* are not inserted into the second locking grooves 91*a*. In this case, the second part 44 of the connection pipe 36 can be freely pivoted to the first part 43 of the connection pipe 36 until it is positioned in the parallel position and the vertical position.

Figure 7A:
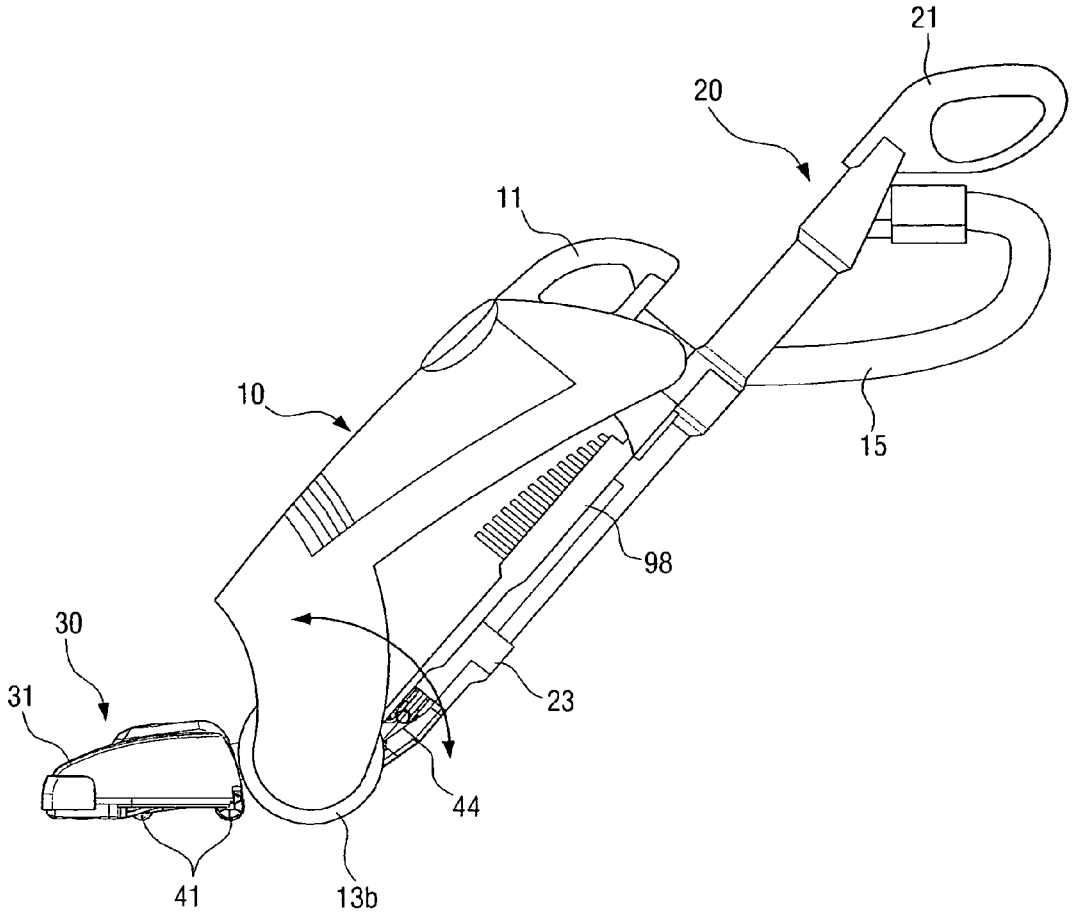
FIG. 7A is a side elevation exemplifying the vacuum cleaner of FIG. 1 used in the upright form.

The vacuum cleaner 1 for using both in the upright form and the canister form having the pivot unit 50 constructed as described above is stored while mounting the cleaner body 10 coupled to the extended tube 20 through the suction hose 15, on the first part 43 and the second pivot 60, as illustrated in FIGS. 1, 2 and 6A. For this, the vacuum cleaner 1 includes a mounting part 95. The mounting part 95 is made up of a mounting protrusion 96, a mounting groove (not shown), and a supporting recess 97. The mounting protrusion 96 is formed in the vicinity of male socket 45 on a top of the other end of the second part 44 of the connection pipe 36. The mounting groove is formed on a lower part of the bottom surface of the cleaner body 10 to correspond to the mounting protrusion 96 thus to accommodate and lock the mounting protrusion 96. The supporting recess 97 is formed on a rear surface of the cleaner body 10 in a shape corresponding to an upper part of the second pivot 60. The supporting recess 97 may be seated and supported on the upper part of the second pivot 60 when the cleaner body 10 is in the storing position of the upright form as illustrated in FIGS. 1 and 6A, and may be separated from the upper part of the second pivot 60 when the cleaner body 10 is in an using position of the upright form as illustrated in FIG. 7A. At this time, to more stably support the cleaner body 10, an elongated groove 98 may be formed on the bottom surface of the cleaner body 10 to accommodate and support a part of the extended tube in a longitudinal direction thereof.

Figure 8:
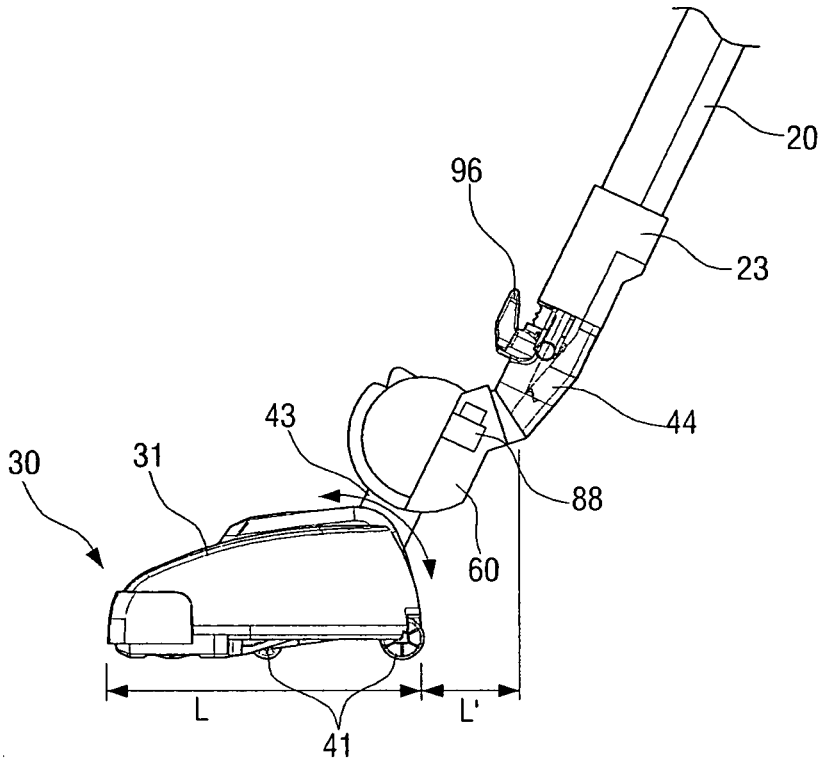
FIG. 8 is a partial side elevation of the suction nozzle assembly of the vacuum cleaner of FIG. 2.

As described above, the vacuum cleaner 1 for using both in the upright form and the canister form according to the exemplary embodiment of the present disclosure is configured, so that the cleaner body 10 is mounted on the first part 43 of the connection pipe 36 and the second pivot 60 instead of the nozzle body 31. Thus, to stably mount and support the cleaner body 10 when the vacuum cleaner 1 is used in the upright form, there is no need to largely increase the nozzle body 31 in size, particularly, back and forth width, as in the conventional vacuum cleaner. For instance, as illustrated in FIG. 8, a back and forth width L of the nozzle body 31 cab be reduced by L'. Accordingly, even though the vacuum cleaner 1 according to the exemplary embodiment of the present disclosure is used in the canister form to clean a surface to be cleaned having a relatively narrow back and forth width, such as a stairway or the like, it can prevent a problem in that a portion of the nozzle body 31 is projected beyond the narrow back and forth width of the stairway to cause the bottom surface of the nozzle body 31 not to come in complete contact with the stairway and thus to deteriorate the dust suction efficiency. In addition, because the first pivot 55 to which user's force and a weight of the extended tube 20 are applied is positioned within the back and forth width of the stairway along with the nozzle body 31, the user can freely move the nozzle body 31 to the stairway and thus easily carry out the cleaning work.

Figure 9A:
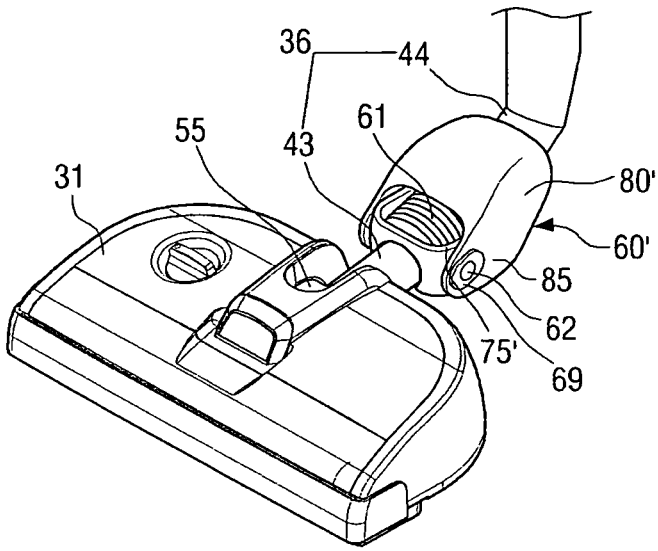
FIGS. 9A and 9B are partial perspective views exemplifying a state that a vacuum cleaner for using both in an upright form and a canister form according to another exemplary embodiment of the present disclosure from which a cleaner body is omitted is used in the upright form.
Figure 9B:
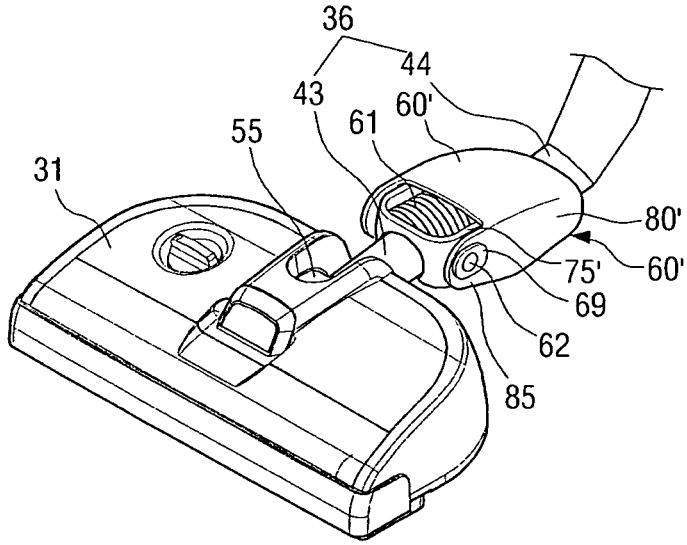

In the above description, although the vacuum cleaner 1 for using both in the upright form and the canister form according to the exemplary embodiment of the present disclosure is illustrated and explained as having the first and the second pivots 55 and 60 made up of the cylinders 56 and 57 and the supporters 59 and 80, the present disclosure is not limited thereto. That is, as illustrated in FIGS. 9A and 9B, one of first and the second pivots, for example, a second pivot 60' may include a flexible hose 61 to connect the first and the second part 43 and 44 of the connection pipe 36. At this time, the flexible hose 61 may be protected by a protection cover 80', which is installed on the second part 44 of the connection pipe 36 to wrap the flexible hose 61. Also, a pivot-locking between the first and the second part 43 and 44 of the connection pipe 36 may be embodied by rotating and tightening a threaded shaft 62 with a knob 69. The threaded shaft 62 threadedly connects both ends of a first bracket 75' of the first part 43 of the connection pipe 36 and a second bracket 85 of the protection cover 80'. Alternatively, the pivot-locking between the first and the second part 43 and 44 of the connection pipe 36 may be embodied by a plurality of locking grooves (not shown) and a plurality of locking protrusions (not shown), which are formed in an angle of approximately 90 degrees around a pivot shaft (not shown) supporting both ends of the first bracket 75' and the second bracket 85 at the both ends of the first bracket 75' and the second bracket 85, respectively.

Hereinafter, an operation of the vacuum cleaner 1 for using both in the upright form and the canister form according to the exemplary embodiment of the present disclosure constructed as described above will now be explained in detail with reference to FIGS. 1 through 8.

First, as illustrated in FIGS. 1 and 6A, when the vacuum cleaner 1 is in a storing position of the upright form, the first part 43 of the connection pipe 36 is positioned approximately parallel to a surface to be cleaned by the first semicircular recess 66 of the first pivot-restricting part 65, and the second part 44 of the connection pipe 36 is positioned in a vertical position having an angle of approximately 90 degrees to the first part 43 of the connection pipe 36 by the second locking part 88 and the second pivot-restricting part 78 of the second pivot 60 (see FIG. 6B). In addition, the cleaner body 10 is mounted on the first part 43 of the connection pipe 36 and the second pivot 60 of the pivot unit 50.

Figure 7B:
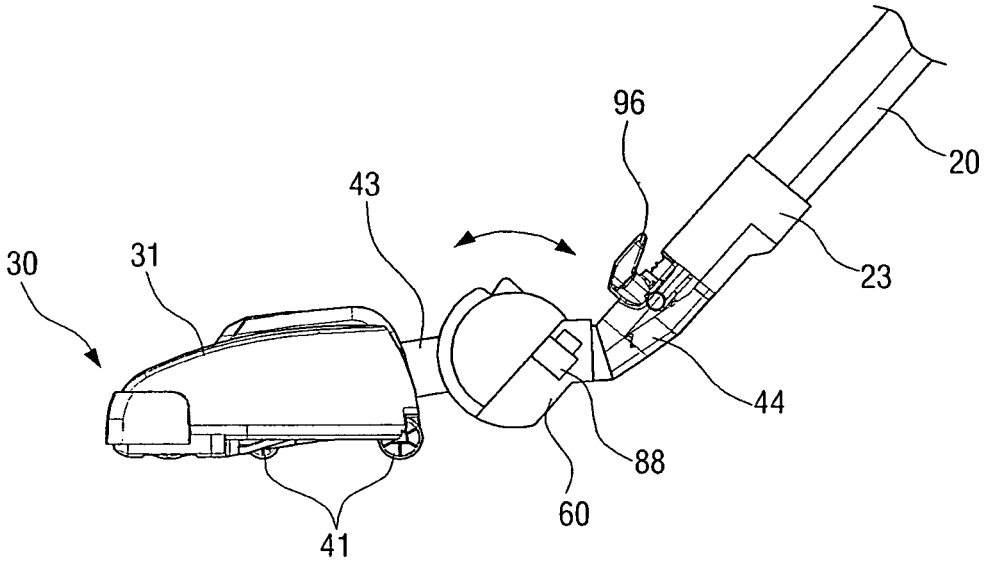
FIG. 7B is a partial side elevation exemplifying the vacuum cleaner of FIG. 7A from which the cleaner body is omitted.

In such a storing position of the upright form, if an user wants to clean a surface to be cleaned having a relatively wide cleaning area, such as a carpet, a floor and the like, by using the vacuum cleaner 1 in the upright form, she or he pushes or touches the lever 92 of the second locking part 88 with one foot or hand to move it down. As a result, as explained with reference to FIGS. 4 and 5, the second locking protrusions 89*a* of the moving member 89 are released from the second locking grooves 91*a* of the fixing member 91 and thus the second part 43 of the connection pipe 36 can be freely pivoted to the first part 43 of the connection pipe 36. In this state, as illustrated in FIGS. 7A and 7B, the user brings the nozzle body 31 in contact with the surface to be cleaned while pivoting the extended tube 20 about the second pivot 60 within a range where the first and the second parts 43 and 44 are not parallel or perpendicular to each other and then performs a cleaning work, by using the operation handle 21 of the extended tube 20.

After the cleaning work is completed, if the user wants to store the vacuum cleaner 1 in the storing position again, she or he pivots the extended tube 20 about the second pivot 60 by using the operation handle 21, so that the first and the second parts 43 and 44 cross at right angles to each other. As a result, as explained with reference to FIG. 5, the second locking protrusions 89*a* are inserted into the second locking grooves 91*a* to lock the pivoting of the second part 44 to the first part 43 of the connection pipe 36. Thus, as illustrated in FIGS. 1 and 6A, the vacuum cleaner 1 returns to the storing position.

Next, to clean a surface to be cleaned having a relatively narrow cleaning area, for example, a narrow back and forth width, such as a stairway or the like, if the user wants to change the vacuum cleaner 1 from the storing position of the upright form as shown in FIGS. 1 and 6A to the canister form, she or he separates the cleaner body 10 from the suction nozzle assembly 30 and the extended tube 20 and then moves the cleaner body 10 onto the surface to be cleaned to allow the front and rear wheels 13*a* and 13*b* to touch the surface to be cleaned, by using the cleaner body handle 11. And then, as the user pushes or touches the lever 92 of the second locking part 88 with one foot or hand to move it down, the second locking protrusions 89*a* of the moving member 89 are released from the second locking grooves 91*a* and thus the second part 43 of the connection pipe 36 can be freely pivoted to the first part 43 of the connection pipe 36, as explained above. In this state, by using the operation handle 21, the user pivots the extended tube 20 about the second pivot 60 to move the first and the second parts 43 and 44 from a vertical position (see FIG. 6B) approximately perpendicular to each other to a parallel position (see FIGS. 2 and 8) approximately parallel to each other. As a result, the second locking protrusions 89*a* are inserted into the second locking grooves 91*a* to lock the pivoting of second part 44 to the first part 43 of the connection pipe 36. Thus, as illustrated in FIGS. 2 and 8, the second part 44 of the connection pipe 36 is fixed approximately parallel to the first part 43 of the connection pipe 36 and the first part 43 of the connection pipe 36 can be pivoted about the first pivot 55 within the angle range of 0 to 90 degrees. In this state, the user brings the nozzle body 31 in contact with the surface to be cleaned while pivoting the extended tube 20 about the first pivot 55 and then performs a cleaning work, by using the operation handle 21 of the extended tube 20.

After the cleaning work is completed, if the user wants to store the vacuum cleaner 1 in the storing position again, she or he operates the vacuum cleaner 1 in a reverse order to the operation of changing it from the storing position of the upright form to the canister form as explained above.

That is, the user pushes or touches the lever 92 of the second locking part 88 with one foot or hand to move it down and thus to allow the second part 43 of the connection pipe 36 to be able to be freely pivoted to the first part 43 of the connection pipe 36. And then, by using the operation handle 21, the user pivots the extended tube 20 about the second pivot 60 to move the first and the second parts 43 and 44 from the parallel position (see FIGS. 2 and 8) approximately parallel to each other to the vertical position (see FIG. 6B) having an angle of approximately 90 degrees to each other, and at the same time, pivots the first part 43 of the connection pipe 36 to be parallel to the surface to be cleaned while coming in contact with the first semicircular recess 66 of the first pivot-restricting part 65. In this state, by using the cleaner body handle 11, the user moves the cleaner body 10 over the suction nozzle assembly 30 and then mounts the cleaner body 10 on the first part 43 of the connection pipe 36 and the second pivot 60 through the mounting part 95. As a result, the vacuum cleaner 1 returns to the storing position as illustrated in FIGS. 1 and 6A.

As described above, the vacuum cleaner for using both in the upright form and the canister form according to the exemplary embodiment of the present disclosure includes the pivot unit having the first pivot to connect the first part of the connection pipe disposed between the extended tube and the nozzle body of the suction nozzle assembly, to the nozzle body to be able to pivot within the first angle range thereto, and the second pivot to connect the second part to the first part of the connection pipe to be able to pivot within the second angle range thereto. Accordingly, the vacuum cleaner form according to the exemplary embodiment of the present disclosure can clean the surface to be cleaned while pivoting the extended tube to the nozzle body by using the first pivot or the second pivot selected according to the using mode, that is, the upright form or the canister form.

That is, when the vacuum cleaner is used in the upright form, which mounts the cleaner body on the first part of the connection pipe and the second pivot, the first part of the connection pipe is positioned approximately parallel to the surface to be cleaned and the second part of the connection pipe can be operated to pivot about the second pivot within the second angle range. Thus, at this time, the vacuum cleaner can be used in a state that an occupied surface-to-be-cleaned space in the vicinity of the nozzle body is relatively enlarged. To the contrary, when the vacuum cleaner is used in the canister form, which separates the cleaner body from the first part of the connection pipe and the second pivot, the second part of the connection pipe is fixed approximately parallel to the first part of the connection pipe and the first part of the connection pipe can be operated to pivot about the first pivot within the first angle range. Thus, at this time, the vacuum cleaner can be used in a state that an occupied surface-to-be-cleaned space in the vicinity of the nozzle body is relatively reduced.

As a result, in the vacuum cleaner for using both in the upright form and the canister form according to the exemplary embodiment of the present disclosure, to stably mount and store the cleaner body on the nozzle body when the vacuum cleaner is used in the upright form, there is no need to largely increase the nozzle body in size, particularly, back and forth width, as in the conventional vacuum cleaner. Accordingly, even though the vacuum cleaner according to the exemplary embodiment of the present disclosure is used in the canister form to clean the surface to be cleaned having the relatively narrow back and forth width, such as the stairway or the like, it can prevent the problem in that the portion of the nozzle body is projected beyond the narrow back and forth width of the stairway to cause the bottom surface of the nozzle body not to come in complete contact with the stairway and thus to deteriorate the dust suction efficiency. In addition, because the first pivot to which the user's force and the weight of the extended tube are applied is positioned within the back and forth width of the stairway along with the nozzle body, the user can freely move the nozzle body while pushing it to the stairway and thus easily carry out the cleaning work.

Although representative exemplary embodiment of the present disclosure has been shown and described in order to exemplify the principle of the present disclosure, the present disclosure is not limited to the specific embodiment. It will be understood that various modifications and changes can be made by one skilled in the art without departing from the spirit and scope of the disclosure as defined by the appended claims. Therefore, it shall be considered that such modifications, changes and equivalents thereof are all included within the scope of the present disclosure.

What is claimed is:

1. A vacuum cleaner for using both in an upright form and a canister form, comprising:

a pivot unit formed to pivot a connection pipe disposed between an extended tube and a nozzle body of a suction nozzle assembly, on at least two points, wherein the connection pipe is divided into at least first and second parts, and the pivot unit pivotably connects between the nozzle body and the first part of the connection pipe and between the first and the second parts of the connection pipe, wherein the pivot unit comprises:

a first pivot to connect the first part of the connection pipe to the nozzle body to be able to pivot within a first angle range thereto; and a second pivot to connect the second part to the first part of the connection pipe to be able to pivot within a second angle range thereto, and wherein, when the vacuum cleaner is used in the canister form, the second part of the connection pipe is fixed approximately parallel to the first part of the connection pipe, and the second part of the connection pipe is operated to pivot within the first angle range about the first pivot.

2. The vacuum cleaner as claimed in claim 1, wherein each of the first and the second angle ranges is between 0 and 90 degrees.

3. The vacuum cleaner as claimed in claim 1, wherein, when the vacuum cleaner is used in the upright form, the first part of the connection pipe is positioned approximately parallel to a surface to be cleaned and the second part of the connection pipe is operated to pivot within the second angle range about the second pivot.

4. The vacuum cleaner as claimed in claim 3, further comprising:

a mounting part to mount a cleaner body connected to the extended tube through a suction hose, on the first part of the connection pipe and the second pivot.

5. The vacuum cleaner as claimed in claim 4, wherein the mounting part comprises:

a mounting protrusion formed on the second part of the connection pipe;

a mounting groove formed on the cleaner body to correspond to the mounting protrusion, and accommodating the mounting protrusion; and a supporting recess formed on a rear surface of the cleaner body in a shape corresponding to an upper part of the second pivot to allow the upper part of the second pivot to be supported therein.

6. The vacuum cleaner as claimed in claim 5, wherein the mounting part further comprises an elongated groove formed on a portion of the cleaner body facing the extended tube to accommodate and support a part of the extended tube.

7. The vacuum cleaner as claimed in claim 1, wherein the first pivot comprises:

a first cylinder coupled in fluid communication with one end of the first part to be perpendicular to the first part and having a suction opening; and a supporter formed on the nozzle body to connect the suction opening with an air passage of the nozzle body and to accommodate and rotatably support the first cylinder.

8. The vacuum cleaner as claimed in claim 7, wherein the supporter comprises a first pivot-restricting part to prevent the first part from pivoting out of the first angle range.

9. The vacuum cleaner as claimed in claim 8, wherein the first pivot-restricting part comprises:

a first semicircular recess formed on the nozzle body to come in contact with the one end of the first part when the first part is in a lower limit of the first angle range; and a second semicircular recess formed on the nozzle body to come in contact with the one end of the first part when the first part is in an upper limit of the first angle range.

10. The vacuum cleaner as claimed in claim 1, wherein the second pivot comprises:

a second cylinder coupled in fluid communication with the other end of the first part to be perpendicular to the first part and having an exhaust opening; and a cylindrical supporter coupled in fluid communication with one end of the second part to be perpendicular to the second part thus to fluidly communicate the exhaust opening with the second part, and accommodating and rotatably supporting the second cylinder.

11. The vacuum cleaner as claimed in claim 10, wherein the cylindrical supporter comprises a second pivot-restricting part to prevent the second part from pivoting out of the second angle range.

12. The vacuum cleaner as claimed in claim 11, wherein the second pivot-restricting part comprises an opening formed on the cylindrical supporter in a circumferential direction thereof, and having a first semicircular groove to come in contact with the other end of the first part when the second part is in an upper limit of the second angle range and a second semicircular groove to come in contact with the other end of the first part when the second part is in a lower limit of the second angle range.

13. The vacuum cleaner as claimed in claim 10, further comprising:

a locking part to lock at least one of the first part and the second part in a first angle and a second angle, respectively.

14. The vacuum cleaner as claimed in claim 13, wherein the locking part locks the second pivot, and the first and second angles comprises 0 and 90 degrees, respectively.

15. The vacuum cleaner as claimed in claim 14, wherein the locking part is formed to release the second part from locking when pushed or touched.

16. The vacuum cleaner as claimed in claim 15, wherein the locking part comprises:

a moving member elastically supported in a moving groove formed at one side of the second cylinder thus to be movable in a horizontal direction and having at one least locking protrusion;

a fixing member fixed on the cylindrical supporter to face the one side of the second cylinder and having at least one locking groove to accommodate the at least one locking protrusion; and a lever elastically supported on the fixing member to be movable in a vertical direction and moving the moving member in the horizontal direction according to upward or downward moving operation to allow the at least one locking protrusion to engage with or disengage from the at least one locking groove.

17. The vacuum cleaner as claimed in claim 16, wherein the locking part locks the rotation of the second part when the second part is in a parallel position approximately parallel to the first part or a vertical position approximately perpendicular to the first part.

18. The vacuum cleaner as claimed in claim 17, wherein the at least one locking protrusion of the moving member comprises four protrusions circumferentially disposed in an angle of 90 degrees on the moving member, and wherein the at least one locking groove of the fixing member comprises four grooves circumferentially disposed in an angle of 90 degrees in the fixing member to face the four protrusions, respectively.

19. The vacuum cleaner as claimed in claim 1, wherein at least one of the first and the second pivots comprises at least one flexible hose to connect at least one of between the nozzle body and the first part and between the first part and the second part.

20. The vacuum cleaner as claimed in claim 19, wherein the at least one flexible hose comprises a protection cover disposed between at least one of the nozzle body and the first part and the first part and the second part to surround the at least one flexible hose.

21. A vacuum cleaner for using both in an upright form and a canister form, comprising:

a pivot unit formed to pivot a connection pipe disposed between an extended tube and a nozzle body of a suction nozzle assembly, on at least two points, wherein the connection pipe is divided into at least first and second parts, and the pivot unit pivotably connects between the nozzle body and the first part of the connection pipe and between the first and the second parts of the connection pipe, wherein the pivot unit comprises:

a first pivot to connect the first part of the connection pipe to the nozzle body to be able to pivot within a first angle range thereto; and a second pivot to connect the second part to the first part of the connection pipe to be able to pivot within a second angle range thereto, and wherein the first pivot comprises:

a first cylinder coupled in fluid communication with one end of the first part to be perpendicular to the first part and having a suction opening; and a supporter formed on the nozzle body to connect the suction opening with an air passage of the nozzle body and to accommodate and rotatably support the first cylinder, wherein the supporter comprises a first pivot-restricting part to prevent the first part from pivoting out of the first angle range.

22. A vacuum cleaner for using both in an upright form and a canister form, comprising:

a pivot unit formed to pivot a connection pipe disposed between an extended tube and a nozzle body of a suction nozzle assembly, on at least two points, wherein the connection pipe is divided into at least first and second parts, and the pivot unit pivotably connects between the nozzle body and the first part of the connection pipe and between the first and the second parts of the connection pipe, wherein the pivot unit comprises:

a first pivot to connect the first part of the connection pipe to the nozzle body to be able to pivot within a first angle range thereto; and a second pivot to connect the second part to the first part of the connection pipe to be able to pivot within a second angle range thereto, wherein the second pivot comprises:

a second cylinder coupled in fluid communication with the other end of the first part to be perpendicular to the first part and having an exhaust opening; and a cylindrical supporter coupled in fluid communication with one end of the second part to be perpendicular to the second part thus to fluidly communicate the exhaust opening with the second part, and accommodating and rotatably supporting the second cylinder.

* * * * *

UNITED STATES PATENT AND TRADEMARK OFFICE

CERTIFICATE OF CORRECTION

PATENT NO. : 8,468,646 B2
APPLICATION NO. : 12/584326
DATED : June 25, 2013
INVENTOR(S) : Dong-Hun Yoo It is certified that error appears in the above-identified patent and that said Letters Patent is hereby corrected as shown below:

On the Title Page, item (30) - Under "Foreign Application Priority Data":

Correct to add: -- Dec. 09, 2008 (KR) 10-2008-0124891 --.

Signed and Sealed this
Twenty-sixth Day of August, 2014

Michelle K. Lee

Michelle K. Lee
*Deputy Director of the United States Patent and Trademark Office*